US008265911B1

(12) United States Patent
Wu et al.

(10) Patent No.: US 8,265,911 B1
(45) Date of Patent: Sep. 11, 2012

(54) SYSTEM AND METHOD FOR MODELING AND SIMULATING WATER DISTRIBUTION AND COLLECTION SYSTEMS INCLUDING VARIABLE SPEED PUMPS

(75) Inventors: Zheng Yi Wu, Watertown, CT (US); Michael E. Tryby, Cincinnati, OH (US); Ezio Todini, Arcidosso (IT); Thomas M. Walski, Nanticoke, PA (US); Wayne R. Hartell, Golden Grove (AU); Kristopher L. Culin, Bristol, CT (US)

(73) Assignee: Bentley Systems, Incorporated, Exton, PA (US)

( * ) Notice: Subject to any disclaimer, the term of this patent is extended or adjusted under 35 U.S.C. 154(b) by 820 days.

(21) Appl. No.: 12/201,529

(22) Filed: Aug. 29, 2008

(51) Int. Cl.
*G06G 7/50* (2006.01)

(52) U.S. Cl. ..... 703/6

(58) Field of Classification Search ..... 703/6, 7, 703/9

See application file for complete search history.

(56) References Cited

U.S. PATENT DOCUMENTS

| | | | | |
|---|---|---|---|---|
| 5,742,500 | A * | 4/1998 | Irvin | 700/9 |
| 5,928,674 | A * | 7/1999 | Hall et al. | 425/4 C |
| 7,013,248 | B1 * | 3/2006 | Todini et al. | 703/2 |
| 2008/0082215 | A1 * | 4/2008 | McDowell | 700/282 |

* cited by examiner

*Primary Examiner* — Kandasamy Thangavelu
*Assistant Examiner* — Andre Pierre Louis
(74) *Attorney, Agent, or Firm* — Cesari and McKenna, LLP

(57) ABSTRACT

In one embodiment, a technique is disclosed for calculating a relative pump speed factor for attaining a prescribed hydraulic head or for pumping a prescribed amount of flow. A hydraulic model of a water distribution or collection system is defined to include link elements and node elements. At least one of the node elements represents a fixed-flow variable speed pump (VSP) that delivers a desired amount of flow, a variable speed pump battery (VSPB) that represents multiple VSPs operating in parallel with each other, a VSP with a tank located on the VSP's discharge side, or a VSP with a tank located on the VSP's suction side.

18 Claims, 13 Drawing Sheets

SYSTEM AND METHOD FOR MODELING AND SIMULATING WATER DISTRIBUTION AND COLLECTION SYSTEMS INCLUDING VARIABLE SPEED PUMPS

BACKGROUND

1. Technical Field

This disclosure relates to the design and modeling of water distribution and collection systems and, more specifically, to techniques for modeling and simulating systems that include variable speed pumps (VSPs).

2. Background

In the design and rehabilitation of water distribution and collection systems of cities, townships, and municipalities and the like, it is important to accurately predict flow and other hydraulic conditions at various points throughout the system. To make such predictions, civil engineers often turn to hydraulic modeling solutions that simulate and predict hydraulic conditions for a real-world water system, based upon a hydraulic model of the system. A hydraulic model typically includes a plurality of links (e.g., pipes) that interconnect nodes (e.g. junctions, pumps, tanks, valves, etc.)

A hydraulic solver, for example, the EPANET Solver available from the U.S Environmental Protection Agency, Washington D.C., may be employed to simulate a hydraulic model to predict flows, hydraulic pressures, and other conditions. A hydraulic solver typically solves a series of mathematical matrices descriptive of the model for various qualities given certain supplied conditions. When solving matrices for system heads and flows, many hydraulic solvers employ the well known Cholesky factorization technique.

Simulation of a hydraulic model may present various challenges depending on the components present in the model. One class of component that has presented challenges is pumps. Pumps may be classified as either constant speed, which operate at a single speed, or variable speed, which operate at different speeds using a variable speed drive (e.g., a variable frequency drive).

Generally, constant speed pumps (CSPs) are less flexible than variable speed pumps (VSPs) when serving target hydraulic characteristics in a system. CSPs operate on one characteristic curve. When a greater system resistance occurs, a CSP delivers a smaller flow. A larger flow may only be supplied with a smaller pumping head (corresponding to overcoming a smaller system resistance). This might prevent a CSP from achieving a target characteristic, for instance, moving adequate flow with target hydraulic head or moving a target flow into a system.

By contrast, a VSP may vary pump speed according to target requirements of a pumping system and thus achieve target hydraulic characteristics. For example, if the target characteristic is a nodal pressure or discharge of a water distribution or collection system, a pressure transducer may be used to regulate a variable frequency drive of the VSP. In this manner, the VSP may operate at any of a plurality of different characterises tics curves. Therefore, VSPs offer more flexibility in realizing target hydraulic characteristics than CSPs.

VSPs have previously been modeled and simulated in several ways. Commonly, an ad-hoc approach was employed, where a CSP element was manually adjusted to function akin to a VSP. For example, an engineer would manually adjust the pump speed of certain CSPs at each of a number of time steps of a simulation to ensure that a target hydraulic head was maintained at a certain location. As is apparent, such manual adjustment had a number of disadvantages. In particular, such adjustment typically required significant attention on the part of the engineer and thus was prohibitively time consuming when a large number of VSPs needed to be modeled and simulated over an extended period of time.

Another approach permitted direct calculation of a speed of a single VSP at a pump station. Details of this approach are provided in Todini et al., U.S. Pat. No. 7,013,248 titled Automatic Parameter Estimating Extension for Variable Speed Pumps, which is incorporated by reference herein. While this approach represented a significant improvement over prior techniques, it did not address all VSP configurations and operation scenarios, including multiple VSPs at one pump station, discharge side storage head control, suction side target head control, fixed-flow control and other more challenging scenarios that may occur in water distribution and collection systems.

Accordingly, what is needed is a technique for modeling and simulating water distribution and collection systems that include VSPs that is more robust and flexible than the existing techniques, to permit modeling and simulation of the more challenging scenarios that prior techniques have not been able to adequately address.

SUMMARY

The present disclosure provides an enhanced VSP solution technique that may be employed by a hydraulic solver of a hydraulic modeling and simulation application to automatically calculate a relative pump speed factor for attaining a prescribed hydraulic head or for pumping a prescribed amount of flow. The enhanced VSP solution technique builds upon a base VSP solution technique, to enable analysis of a variety of more challenging VSP configurations that may occur in real-world systems.

In one embodiment, the enhanced VSP solution technique enables modeling and simulation of a VSP delivering a desired amount of flow, i.e., a fixed-flow VSP. The enhanced VSP solution technique maintains calculated pump flow for the VSP equal to a target flow of the VSP over iterations of the solution technique, by imposing the requirement that $q_i^{k+1}=q_i^{k}=q_i^{target}$, where $q_i^{k}$ is calculated flow for pump i at a k-th iteration; $q_i^{k+1}$ is calculated flow for pump i at a (k+1)-th iteration and $q_i^{target}$ is the target flow for pump i.

In another embodiment, the enhanced VSP solution technique enables modeling and simulation of a multiple VSPs operating in parallel to meet target hydraulic characteristics. A new VSP battery (VSPB) element is provided for use in hydraulic models. The VSPB element represents a group of multiple VSPs that operate in parallel with each other (i.e., not in-line) b) share common upstream (i.e., inflow) and downstream (i.e., outflow) nodes; c) are identical (i.e., have the same pump characteristic curves); and are controlled by the same target node and same target head, or are expected to move the same target flow. The enhanced VSP solution technique models a VSPB element as an equivalent pump, having just one pump equation. The pump equation is then solved and the actual number of VSPs of the VSPB on then duty is determined by calculating a required speed factor within specified minimum and maximum limits.

In yet another embodiment, the enhanced VSP solution technique enables modeling and simulation of VSPs with initial statuses and operating under rules-based controls. For example, rule-based controls may be specified by IF-THEN and/or IF-THEN-ELSE semantics. In this embodiment, the enhanced VSP solution technique implements conditional logic to account for these scenarios and to generate the proper operating status of "on" or "off" for each VSP. Specifically, initial status and control status limits the possible calculated status of each VSP.

In still another embodiment, the enhanced VSP solution technique enables modeling and simulation of VSPs for maintaining fixed-head of a storage tank located at either the discharge side or the suction side of a VSP. In such configurations, the tank may be selected as the control node for the VSP and pump speed controlled to maintain a certain tank level.

In the case of a discharge side tank controlling a VSP, the tank's initial head should be sustained by increasing speed to fill the tank as soon as the tank begins to drain, and by reducing speed to maintain the tank level as soon as the water level increases when the system demand decreases. The enhanced VSP solution technique addresses this by incorporating three controls. First, when the actual tank level is lower than the target level a VSP is ramped up to the maximum allowed speed in case the target head cannot be met for a given time step of a simulation. Second, when the tank level is greater than the target level, a VSP is turned off to allow the tank to drain. Third, when the tank level is restored at the target level a VSP is kept at the mode of variable speed operation to maintain the target level.

In a situation where a suction side tank is selected as the VSP control node, the VSP is expected to keep the tank level substantially constant. The enhanced VSP solution technique addresses this issue by incorporating two controls when modeling a scenario involving a suction side tank. First, when the tank level is greater than the target level, a VSP is turned off to allow the tank to drain. Second, when the tank level is restored at the target level, a VSP is kept in a mode of variable speed operation to maintain the target level.

In this manner, the extended VSP solution technique enables calculation of pump speed under a wide range of more challenging VSP configurations, which have not been adequately addressed by prior techniques.

BRIEF DESCRIPTION OF THE DRAWINGS

The description below refers to the accompanying drawings, of which.

DETAILED DESCRIPTION OF ILLUSTRATIVE EMBODIMENTS

Figure 1:
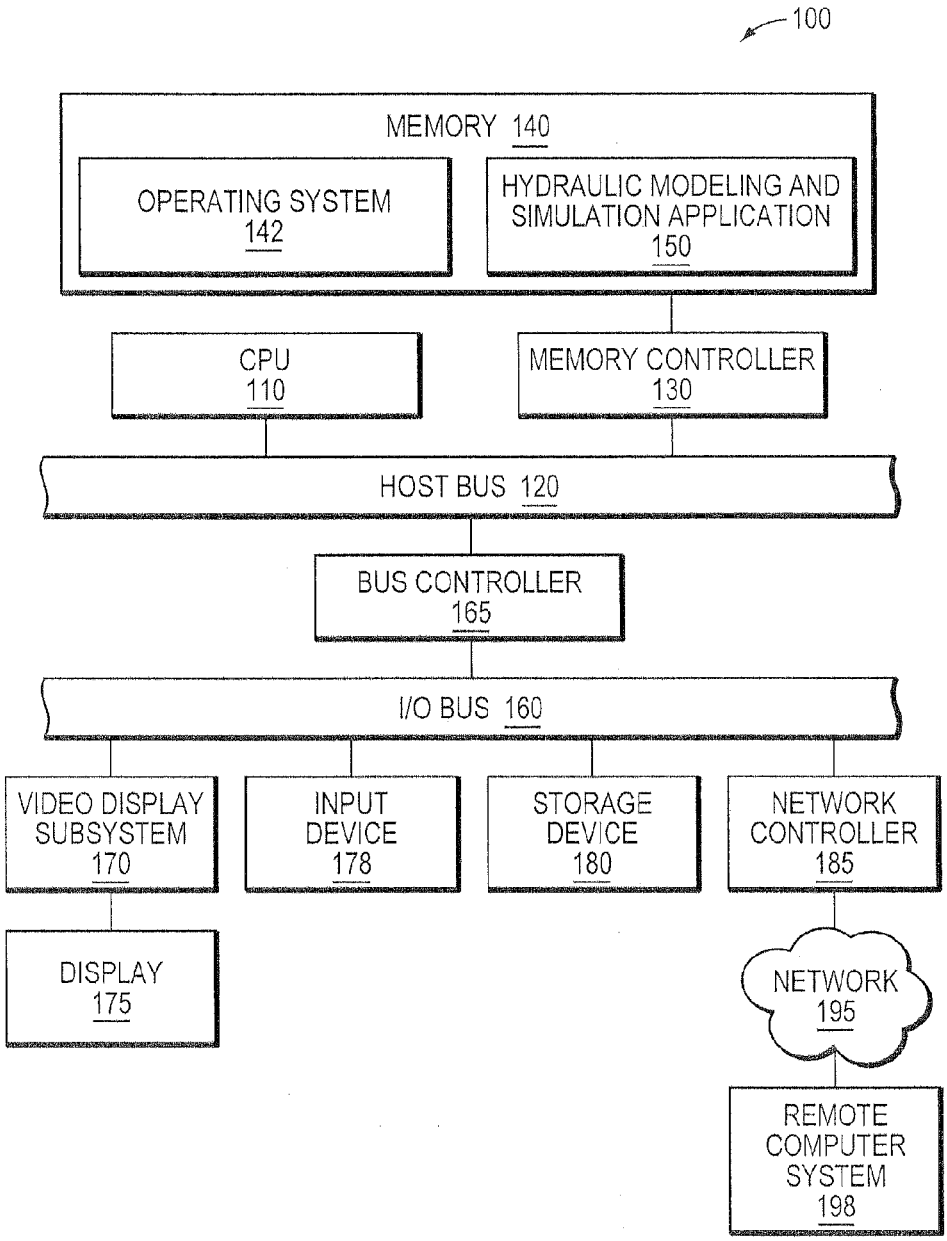
FIG. 1 is a block diagram of an example computer system in which at least some of the presently described techniques may be employed.

FIG. 1 is a block diagram of an example computer system 100 in which at least some of the presently described techniques may be employed. The computer system 100 includes at least one central processing unit (CPU) 110 coupled to a host bus 120. The CPU 110 may be any of a variety of commercially available processors, such as an Intel x86 processor, an IBM PowerPC processor, a SPARC processor, or another type of processor. A volatile memory 140, such as a Random Access Memory (RAM), is coupled to the host bus 120 via a memory controller 130. The volatile memory 140 is configured to store at least a portion of data, including computer-executable instructions, for an operating system 142 while the computer system 100 is operating. In addition, the volatile memory 140 may store portions of application software, including portions of a hydraulic modeling and simulation application 150 while the computer system 100 is operating.

The host bus 120 of the computer system 100 is coupled to an input/output (I/O) bus 160, such as a Peripheral Component Interconnect (PCI) bus, through a bus controller 165. A video display subsystem 170, coupled to a display 175, may be connected to the I/O bus 160. The display 175 may show an on-screen display of the hydraulic modeling and simulation application 150. Similarly, one or more input devices 178, such as, a keyboard, a mouse, or a touch pad, may allow a user to interface with the hydraulic modeling and simulation application 150.

A storage device 180, such as hard disk drive, a compact disk (CD), Digital Video Disc (DVD), or other type of computer-readable storage medium, may be coupled to the I/O bus 160 and persistently store data, including computer-executable instructions. Such persistently stored data may be loaded to the volatile memory 140 when needed. For example, computer-executable instructions related to the operating system 142 or the hydraulic modeling and simulation application 150, may be stored in the storage device 180 until they are needed.

The I/O bus 160 may be further coupled to a network controller 185 that interfaces with a computer network 195. The computer network 195 may allow communication between the computer system 100 and other computer systems, for example, a remote computer system 198, using any of a number of well-known network protocols. Such network communication may allow certain remote, distributed and/or parallel computing configurations, in which some or all of the techniques discussed herein are implemented on different computing platforms.

Figure 2:
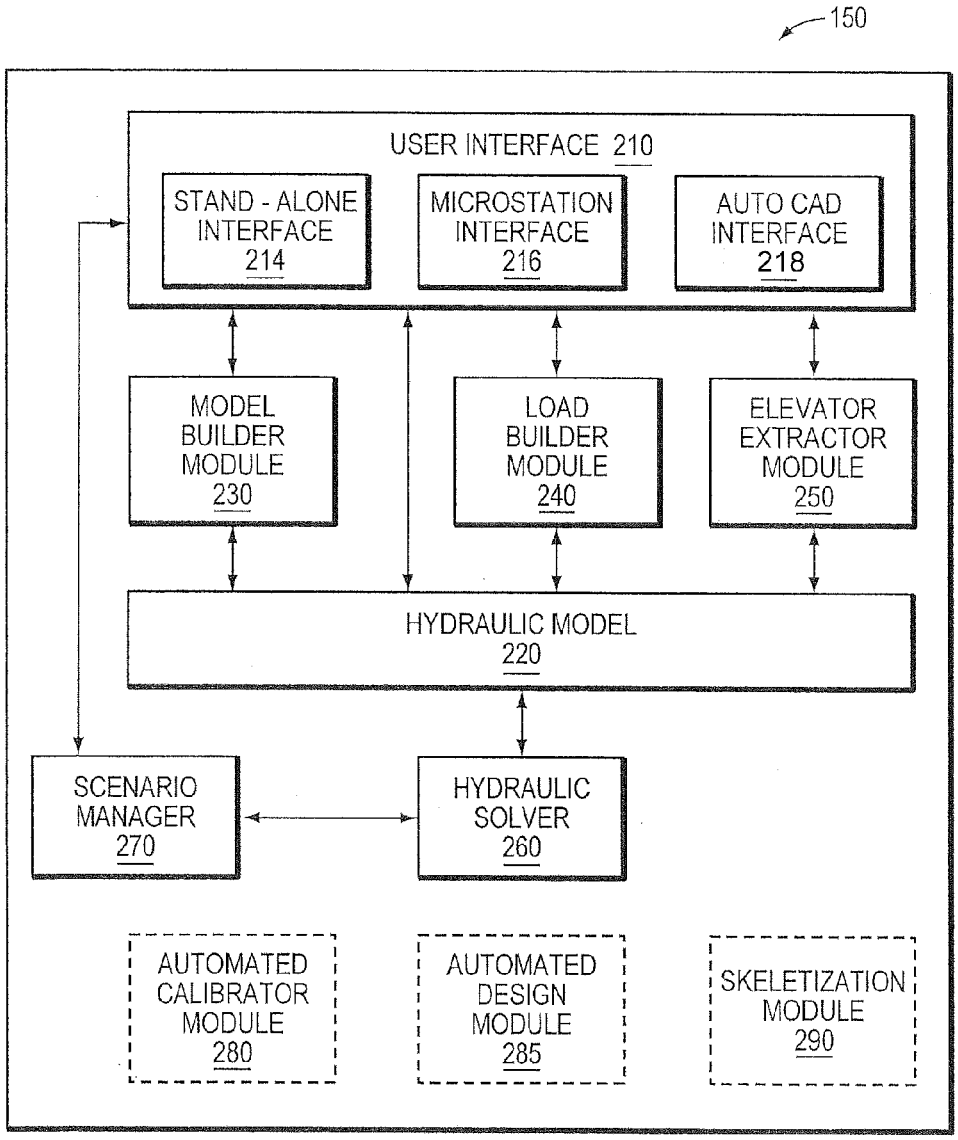
FIG. 2 is an expanded block diagram of an example hydraulic modeling and simulation application depicting core functionality, as well as a plurality of optional modules.

FIG. 2 is an expanded block diagram of an example hydraulic modeling and simulation application 150 that may operate on the computer system 100. While the hydraulic modeling and simulation application 150 may be any of a variety of types of fluid conveyance system modeling and/or simulation applications, in the preferred embodiment, it is the WaterCAD® water distribution modeling and management solution available from Bentley Systems, Inc of Exton, Pa. The application 150 may be structured to include certain core interfaces and modules (i.e., core functionality), as well as one or more optional "add-on" modules.

In reference to FIG. 2, the core functionality may include a user interface 210 to receive input from, and display output to a user. Such user interface 210 may provide a variety of ways of interacting with the hydraulic modeling and simulation application 150. For example, the user interface 210 may include routines that implement a stand-alone interface 214. The user interface 210 may further include routines that implement interfaces that operate within, or in close cooperation with, other software applications. For example, a MicroStation® 216 interface may permit a user to layout and analyze a hydraulic model from within one of the MicroStation® suite of computer aided design (CAD) software products available from Bentley Systems, while an AutoCAD® 218 interface may provide similar functionality in conjunction with AutoCAD® CAD software available from Autodesk, Inc of San Rafael, Calif.

A user may employ the user interface 210 to manually create a hydraulic model 220 of a water distribution and collection systems. For example, a user may directly select elements (i.e., representations of objects in a network) including link elements, such as pipes, and node elements, such as junctions, tanks, and valves, constant speed pumps (CSPs), variable speed pumps (VSPs), and VSP batteries (VSPBs). The user may then place and interconnect these elements in a desired manner in a drawing. The user may further and assign each element appropriate element attributes (i.e., fundamental, often numeric, properties of the element). For example, a pipe element may be assigned attributes including a diameter, a length, and a roughness.

Further, in some configurations, at least a portion of the hydraulic model 220 may be built using data from an existing data source. For example, a model builder module 230 may accept differing types of data, such as database data, spreadsheet data, and/or geographic information system (GIS) data, and use such data to define elements and element attributes in the hydraulic model 220. Similarly, a load builder module 240 may accept collected information descriptive of demands in a real-world water distribution or collection system and spatially allocate these demands within the hydraulic model 220. Further, an elevation extractor module 250 may automatically assign elevations to elements within the hydraulic model 220 according to stored elevation data.

While the hydraulic model 220 may be graphically represented to a user by the user interface 210, underlying this graphical representation is typically a complex series of mathematical matrices descriptive of the hydraulic model 220. A hydraulic solver 260 is generally employed to operate upon these underlying mathematical matrices, to simulate or analyze the hydraulic model 220 to predict flows, hydraulic pressure and/or other conditions. The hydraulic solver 260 may be capable of providing a variety of types of simulation and analysis including steady-state analysis, extended-period simulation (EPS), constituent-concentration analysis, source tracing, criticality analysis, variable-speed pumping analysis, among other types of simulation and analysis. Further, the hydraulic solver 260 may work in conjunction with a scenario manager 270 to calculate multiple "what if" situations and alternatives. Results determined by the hydraulic solver 260 may be reported to a user, for example via the user interface 210, or may be stored in a volatile memory 140, a storage device 180, or other computer-readable storage medium for subsequent use.

In addition to the above-described core functionality, the example hydraulic modeling and simulation application 150 may include a number of optional "add-on" modules. For example, an automated calibrator module 280 may provide automated model calibration to ensure the hydraulic model 220 truly reflects a real-world water distribution or collection system. Such module 280 may accept real-world field measurements, generate a large number of possible solutions, and then use these to calibrate the hydraulic model 220, for example, by selecting optimum values for pipe roughness, junction demands, and element status (e.g., whether a valve is open or closed). Similarly, an automated design module 285 may operate to evaluate a large number of design and rehabilitation alternatives that meet hydraulic constraints to determine an optimum solution. Such module 285 may accept design requirements, for example, maximum and minimum pressures and velocities, and accept optimization objectives, for example, cost, benefit, or cost-benefit trade-off, and then using cost tables or functions evaluate a large number of valid design solutions, choosing an optimum solution. Further, a skeletization module 290 may operate to simplify the hydraulic model 220 to differing levels of complexity more appropriate for certain tasks, while maintaining connectivity and hydraulic equivalence and while reallocating assigned demands.

Figure 3:
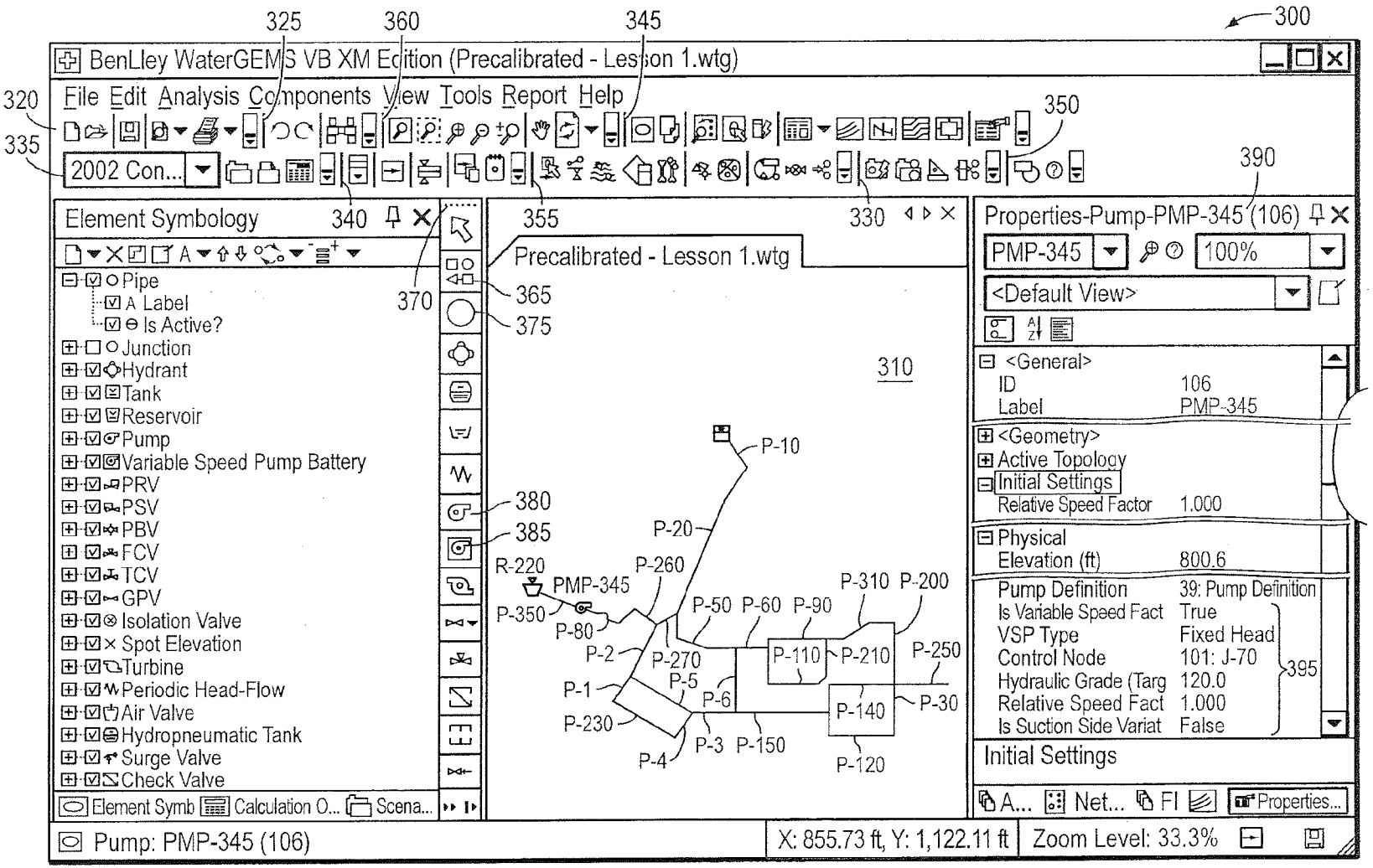
FIG. 3 is an example on-screen display that may be presented by a stand-alone interface of the hydraulic modeling and simulation application, to permit a user to specify and configure VSPs.

FIG. 3 is an example on-screen display 300 that may be presented by the stand-alone interface 214 of the hydraulic modeling and simulation application 150 that permits a user to specify and configure VSPs. A drawing pane 310 is provided to show a graphical depiction of the hydraulic model 220. In this example, a plurality of link elements, such as pipes P-1, P-2, P-80, P-350, etc. are shown interconnecting node elements, such as VSP PMP-345.

A plurality of toolbars are provided for interacting with the hydraulic model 220. Such toolbars may include a File Toolbar 320, an Edit Toolbar 325, an Analysis Toolbar 330, a Scenarios Toolbar 335, a Compute Toolbar 340, a View Toolbar 345, a Help Toolbar 350, Tools Toolbar 355, and/or a Zoom Toolbar 360 that provide various functions. In particular, a Layout Toolbar 370 may be provided that includes a plurality of tools for creating and/or manipulating elements. For example, a pipe tool 365 and a junction tool 375 are provided in the toolbar 370 for creating pipe and junction elements respectively. Similarly, a pump tool 380 is provided in the toolbar 370 for creating pump elements, including both constant speed pump elements and VSP elements. Further, a VSP battery (VSPB) tool 385 is provided in the toolbar 370 that, when manipulated, creates VSPB elements which represent multiple VSPs that meet certain criteria.

Further, properties tabs are provided for specifying and/or viewing properties of elements in the hydraulic model 220. For example, a pump properties tab 390 may be displayed to show a plurality of fields relating to a specific pump, for example, VSP PMP-345. A user may specify and/or view VSP data in a number of VSP related fields 395. For instance, a user may use these fields to specify VSP Type, the control node of the VSP, the hydraulic grade, the relative pump speed factor and/or other properties.

Once a user has created a hydraulic model 220, the user may desire to simulate the hydraulic model. However, such simulation has been a challenge when the model 220 includes VSPs in certain types of configurations. As discussed above, conventional hydraulic modeling and simulation techniques have either required a user to manually adjust the speed of CSPs to achieve target hydraulic performance, or have been limited to only certain types of operation scenarios.

The present disclosure describes an enhanced VSP solution technique that may be employed by a hydraulic solver 260 of the hydraulic modeling and simulation application 150 to automatically calculate a relative pump speed factor for attaining a prescribed hydraulic head or for pumping a prescribed amount of flow. As used herein, a speed factor is defined as a ratio of a pump's actual speed to some reference speed, for example, the full speed of a motor of the pump. The enhanced VSP solution technique enables analysis of not only a single variable speed pump, but also of multiple variable speed pumps with rule-based logic controls. Advantageously, target control head may be specified at any location, or target flow may be specified for VSPs of differing capabilities.

The enhance VSP solution technique builds upon a base solution technique. The base technique may model a VSP with a prescribed target head using a reformulation of the matrix system of the Global Gradient Algorithm (GGA). The base technique begins with an initial estimate of flows in each pipe and proceeds with iterations until there is negligible change in new pipe flow distributions. For each GGA iteration, new nodal heads are calculated by solving the matrix equation:

$$AH=F \tag{1}$$

Where A is an (N×N) Jacobian matrix; H is an (N×1) vector of unknown nodal heads, and F is an (N×1) vector of right hand side terms, where N is the number of nodes. Within the GGA, the hydraulic characteristic of a pump connecting from node i to node j is represented by a power law given as:

$$H_i-H_j=\omega^2(h_0-r(Q_{ij}/\omega)^n) \tag{2}$$

or $$H_i-H_j=-(a_0\omega^2+b_0Q_{ij}\omega+c_0Q_{ij}^2) \tag{3}$$

Where $H_i$ and $H_j$ are hydraulic heads at node i and j respectively; $h_0$ is the shutoff head for the pump; r, n, $a_0$, $b_0$, $c_0$ are the pump curve coefficients and w is the relative pump speed factor. This modeling approach assumes that the relative pump speed factor is given as a known value. Accordingly, in order to achieve a desired hydraulic characteristic, trial-and-error has previously been applied to work out the correct speed factor.

To directly calculate pump speed for a given target hydraulic characteristic e.g., hydraulic head, the pump power law equations Eq. (2) and Eq. (3) may be rearranged to add an extra head to take into account of different pump speed from the constant pump speed factor of 1.0. Thus, both equations Eq. (2) and Eq. (3) are equivalently transformed as:

$$H_i-H_j=-(h_0-rQ_{ij}^n)+\delta_{ij} \tag{4}$$

or $$H_i-H_j=-(a_0+b_0Q_{ij}+c_0Q_{ij}^2)+\delta_{ij} \tag{5}$$

where $\delta_{ij}$ is the head difference required for meeting the specified target head. The extra term $\delta_{ij}$ results in a nonsymmetrical solution matrix for GGA formulation. The nonsymmetrical GGA matrix system is solved by partitioning the governing matrix system into two portions, namely the symmetrical and nonsymmetrical matrixes given as follows:

$$\begin{bmatrix} H^{k+1} \\ \dots \\ \Delta^{k+1} \end{bmatrix} = \begin{bmatrix} A_{ss} & \vdots & A_{sn} \\ \dots & \dots & \dots \\ A_{ns} & \vdots & 0 \end{bmatrix}^{-1} \begin{bmatrix} F_1 \\ \dots \\ F_2 \end{bmatrix} \tag{6}$$

Where $A_{ss}$ is the symmetrical part of the original matrix from which rows and columns have been eliminated for the newly fixed-head nodes that are specified as VSP control targets. $A_{sn}$ is a matrix formed by the columns and $A_{ns}$ from the rows eliminated from the matrix A. $F_1$ and $F_2$ are the corresponding vectors of right hand side terms. The partitioned matrix system is solved for the fixed-head VSP analysis within the same iteration loop of the original GGA.

After the reformulated matrix system is solved for link flows and node hydraulic heads, a VPS speed factor can be solved by rearranging Eq. (2) and Eq. (4) for a pump using a power law pump curve, given as:

$$h_0(1-\omega^2)-rQ_{ij}(1-\omega^2/\omega^n)=\delta_{ij} \tag{7}$$

or rearranging Eq. (3) and Eq. (5) for a pump using a quadratic pump curve, given as:

$$a_0\omega^2+b_0Q_{ij}\omega+(\delta_{ij}-a_0-b_0Q_{ij})=0 \tag{8}$$

Eq. (8) may be directly solved for a VSP speed factor while the nonlinear equation Eq. (7) may be solved for a VSP speed factor by using the well-known Newton-Raphson method.

The base VSP solution technique described above may be employed to directly compute the speed factor of a VSP to sufficiently keep up with a fixed hydraulic head at a control node. However, a wide range other VSP configurations that occur in real-world systems need to also be effectively handled.

One type of more challenging VSP configuration is modeling a VSP delivering a desired amount of flow, i.e., modeling a fixed-flow VSP. This is the typical control case when a pump is supplying water to an "open" system where a tank is located downstream.

Another type of more challenging VSP configuration is modeling VSPs operating in parallel to deliver target hydraulic characteristics. In such a case, if a primary (i.e., lead) VSP alone cannot deliver the target hydraulic characteristics operating a maximum speed, then a second VSP should be triggered to operate at a common speed with the lead VSP. If the target hydraulic characteristics still cannot be achieved while both VSPs are operating at a maximum speed, then, if available, still another VSP should also be activated, and so on, until the target characteristics are met.

Yet another type of more challenging VSP configuration is modeling VSPs imposed under rules-based controls, in addition to target hydraulic characteristics of either fixed-head or fixed pump flow. For example, rule-based controls may be specified by IF-THEN and/or IF-THEN-ELSE semantics.

Still another type of more challenging VSP configuration is modeling a VSP for maintaining fixed-head of a storage tank (or wet well) located at either the discharge side or suction side of the VSP. In such configurations, a tank (or wet well) may be selected as the control node for the VSP and pump speed controlled to maintain a certain tank (or wet well) level.

To address these more challenging VSP configurations, the hydraulic solver 260 of the hydraulic modeling and simulation application 150 is configured to implement an enhanced VSP solution technique that extends the base technique described above.

In a first embodiment, the technique is enhanced to provide for fixed-flow VSPs. To model desired flow through a VSP in a hydraulic model 220 that includes storage tank elements, one should ensure that the calculated pump flow is the exact same amount as expected over GGA iterations. Unlike fixed-head VSP analysis, solving for fixed-flow requires that the VSP flow be kept constant over iterations such that:

$$q_i^{k+1}=q_i^k=q_i^{target} \quad (9)$$

Where $q_i^k$ is the calculated flow for pump i at the k-th iteration; $q_i^{k+1}$ is the calculated flow for pump i at the (k+1)-th iteration and $q_i^{target}$ the target flow for pump i. The governing equation system given by Eq. (6) along with Eq. (9) is computationally adequate to warranty the flow balance and also the target flow moved through a variable speed pump.

Figure 4:
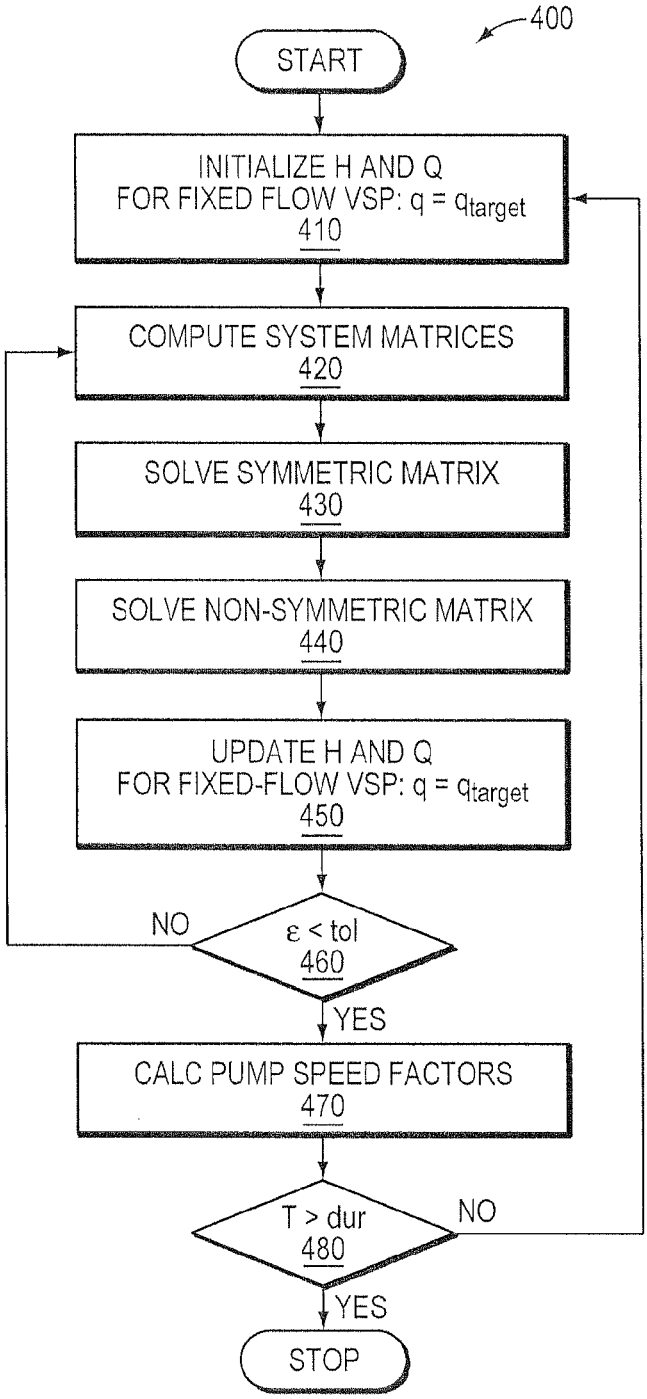
FIG. 4 is an example data flow and calculation diagram of a sequence of steps used by the enhanced VSP solution technique.

FIG. 4 is an example data flow and calculation diagram of a sequence of steps 400 used by the enhanced VSP solution technique. While FIG. 4 contains certain statements that are specific to solving for fixed-flow VSP control, it should be apparent that the underlying steps shown in FIG. 4 are applicable to the other VSP configurations discussed below. The sequence of steps 400 starts at a first time step of a simulation where, at step 410, values for hydraulic heads (H) and link flows (Q) are initialized. Further, if a fixed-flow VSP is included in the hydraulic model 220, the target flow is set according to the above equations. At step 420, matrix system coefficients are computed to take into account features of the hydraulic model 220. The system matrixes are then partitioned in symmetric and non-symmetric matrixes. At steps 430 and 440 the symmetric and non-symmetric matrixes are solved. Solution of the matrices determines new values for the hydraulic heads (H), which in turn are used to determined new values of the link flows (Q). At step 450, current hydraulic heads (H) and link flows (Q) are updated with the newly determined values. It should be remembered that, if a fixed-flow VSP is included in the hydraulic model 220, the target flow is kept constant.

At step 460, a flow change (c) between current flow values and the newly determined flow values is determined and compared with a preset accuracy tolerance (tol). If the flow change is less than the accuracy tolerance, execution proceeds to step 470. Otherwise, execution loops back to step 420. At step 470, once a flow balance calculation is achieved with known link flows and nodal hydraulic heads, the actual VSP speed factor may be calculated, for example, by solving Eq. (7) or Eq. (8) described above. At step 480, a check is performed to determine if a current time step (T) is greater than a simulation duration (dur). If not, model calculation continues for a subsequent time step of the simulation, and execution loops back to step 410. Otherwise, model calculation may terminate and simulation results may be displayed to a user, for example via the display 175. Alternatively, simulation results may be stored, or otherwise used.

Figure 5:
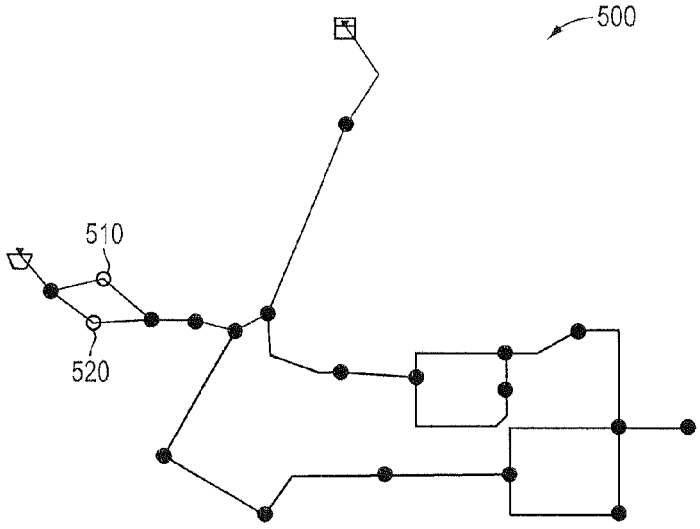
FIG. 5 is a schematic diagram of an example water distribution system that includes fixed-flow VSPs, which may be used to demonstrate an application of the enhanced VSP solution technique.

FIG. 5 is a schematic diagram of an example water distribution system 500 that includes fixed-flow VSPs, which may be used to demonstrate an application of the enhanced VSP solution technique. In a first example scenario, a first pump 510, is set to deliver a fixed-flow of 60 L/s over a 24 hours simulation period, and the required pump speed factor is to be calculated at each simulation time step. In a second example scenario, the first pump 510 and a second pump 520, are set to deliver fixed-flow s of 34.69 L/s and 25.23 L/s, respectively. Their speed factors are to be directly calculated for each time step.

Figure 6:
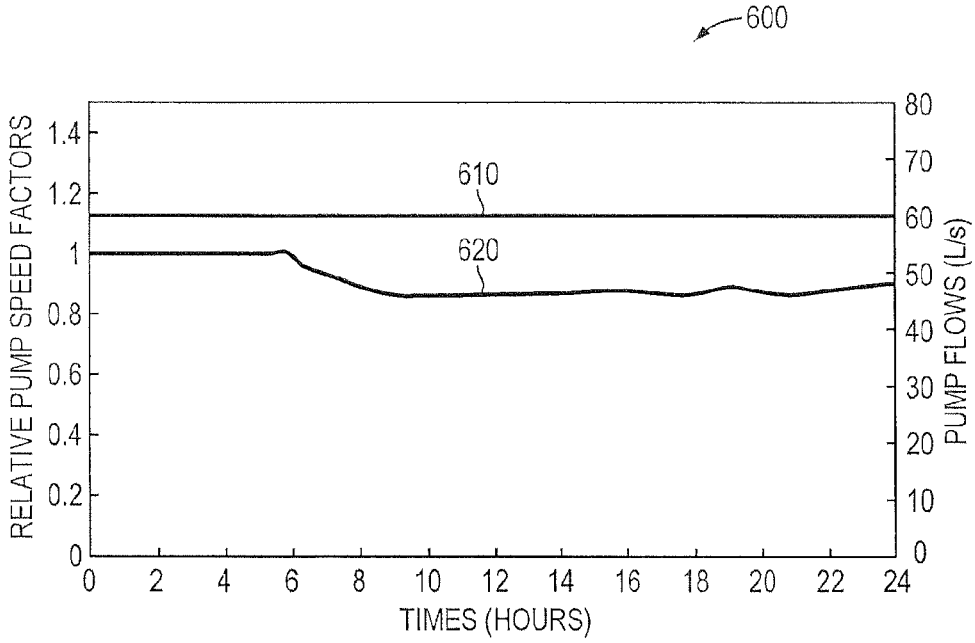
FIG. 6 depicts a graph of simulated results for a first scenario discussed in reference to FIG. 5.

FIG. 6 depicts a graph 600 of simulated results for the first scenario discussed in reference to FIG. 5, calculated using the enhanced VSP solution technique. The first pump 510 pumps a fixed-flow of 60 L/s as depicted by the calculated flow line 610. The speed factor changes according to system head variation as depicted by the calculated speed factor line 620.

Figure 7:
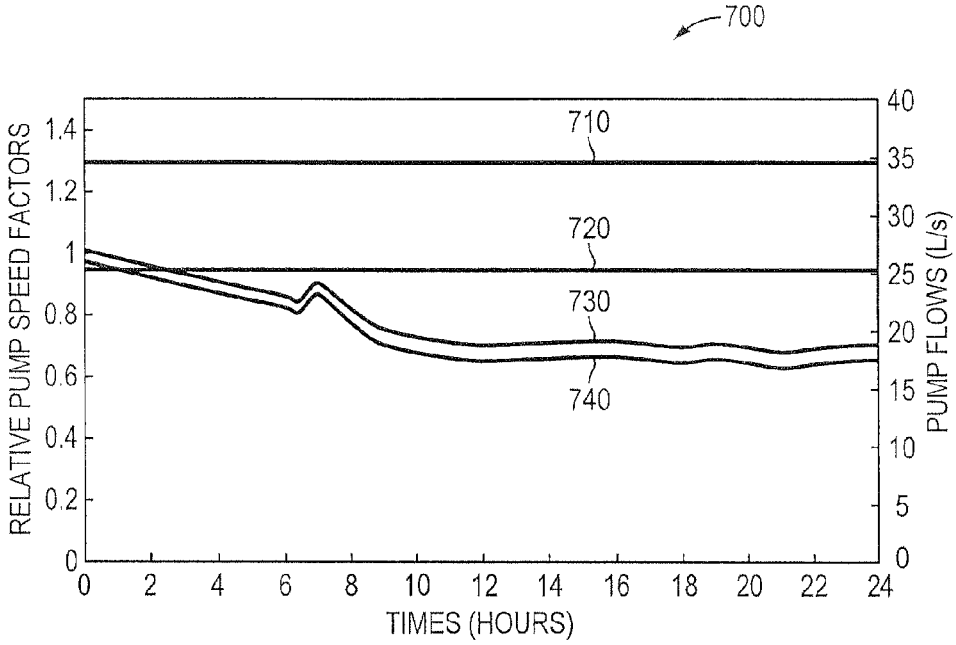
FIG. 7 depicts a graph of simulated results for a second scenario discussed in reference to FIG. 5.

FIG. 7 depicts a graph 700 of simulated results for the second scenario discussed in reference to FIG. 5, calculated using the enhanced VSP solution technique. The first pump 510 and the second pump 520 share a total flow of 60 L/s, each pump specified to move a target flow of 35 L/S and 25 L/S respectively, as shown by calculated flow lines 710, 720. The calculated pump speed factors vary according to system head across the system, as depicted by the calculated speed factor line 730, 740. These scenarios illustrate that the enhanced VSP solution technique is able to model and simulate multiple VSPs of different pump characteristics (pump curves) for different target flows, expanding on the capabilities of prior techniques.

In a second embodiment, the enhanced VSP solution technique extends the base technique described above to enable solution for multiple parallel VSPs. When multiple pumps are placed in parallel and operated as VSPs at one pump station, it is expected that they will deliver the same hydraulic head and operate at the same speed. Parallel VSPs are typically led by a primary (i.e., lead) VSP. The other VSPs at the same station that operate in support of the lead VSP are typically referred to as lag VSPs. A lag VSP is typically turned on and ramped up to the same speed as the lead VSP when the lead VSP cannot meet a desired target head. If all lag VSPs are run at maximum allowed speed, but the target head is still not achieved, the VSPs are operated at the maximum allowed speed. A lag VSP is turned off when the lead VSP is able to deliver the target head by itself.

The enhanced VSP solution technique may be employed in conjunction with a new VSP battery (VSPB) element that represents a group of pumps, to model and simulate the use of multiple variable speed pumps operating together. As described above, a VSPB tool 385 may be provided in a Layout Toolbar 370 that allows a user to creating VSPB elements which represent multiple VSPs that meet certain criteria. In the preferred embodiment, these criteria require that: a) the VSPs are parallel with each other (i.e. not in-line); b) the VSPs share common upstream (i.e., inflow) and downstream (i.e., outflow) nodes; c) the VSPs are identical (i.e., have the same pump curve); and d) the VSPs are controlled by the same target node and same target head, or the VSPs are expected to move the same target flow.

From the standpoint of input data, a VSPB element may be treated in the same manner a VSP element, with that exception that a number of lag pumps should be defined. A user need not specify duplicate data for each of the multiple pumps of a battery as such information may be inferred. When simulating a VSPB element, the battery is treated as an equivalent pump having the same characteristics as the parallel VSPs. By treating a battery as an equivalent pump, the multiple VSPs of the battery may be represented by just one pump equation in the form of Eq. (4) or Eq. (5). As such, substantially the same solution technique as depicted in FIG. 4 may be applied, with the exception that the calculated flow for the equivalent VSP is expected to be shared by all the parallel VSPs. The actual number of parallel VSPs on duty is determined by calculating the required speed factor within specified minimum and maximum limits after the extended VSP solution technique solves the matrix system.

Figure 8:
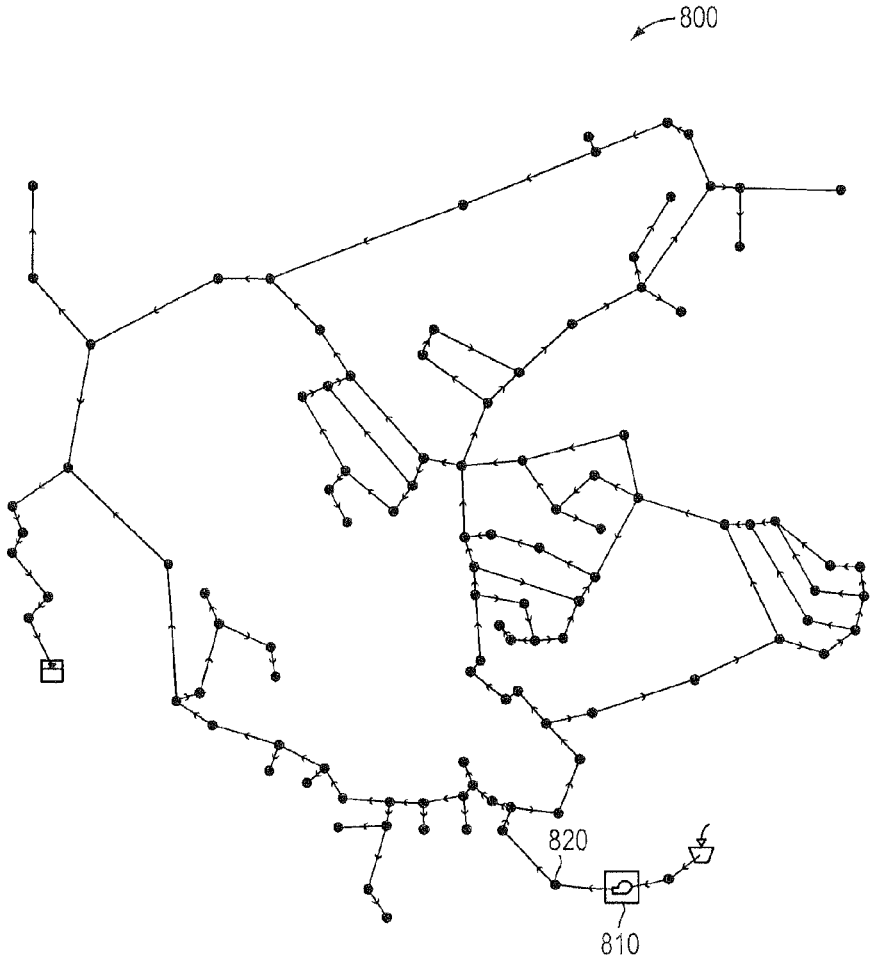
FIG. 8 is a schematic diagram of an example water distribution system that includes a VSPB comprising one lead VSP and two lag VSPs, which may be used to demonstrate an application of the enhanced VSP solution technique.

FIG. 8 is a schematic diagram of an example water distribution system 800 that includes a VSPB 810 comprising one lead VSP and two lag VSPs, which may be used to demonstrate an application of the enhanced VSP solution technique. In one scenario, the VSPB operates as a fixed-head VSP for delivering a hydraulic grade of 137.16 meters at a target node 820 located at the VSPB's discharge side over a 24 hours simulation period. The required pump speed factor is to be calculated at each simulation time step.

Figure 9:
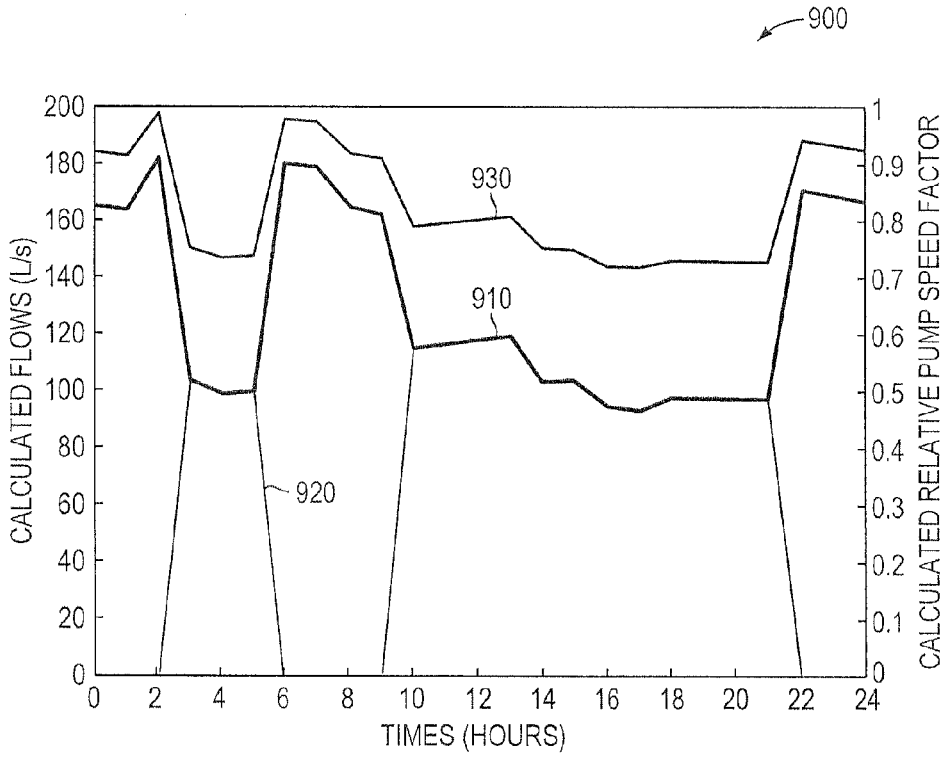
FIG. 9 depicts a graph of simulated results for a scenario discussed in reference to FIG. 8.

FIG. 9 depicts a graph 900 of simulated results for the scenario discussed in reference to FIG. 8, calculated using the enhanced VSP solution technique. A lead pump flow line 910 and a lag pump flow line 920 represent the respective pumps flows. Further a pump speed factor line 930 represents a speed factor of the pumps of the VSPB. In this example simulation, the enhanced VSP solution technique determines that only the lead pump initially should be turned on, as system demand is low. As demand increases, beginning at about 1:00 A.M., the lead pump ramps up the speed, however the lag pump remains on standby. Eventually, the lead pump cannot meet the full-speed demand, beginning at about 2:00 A.M, and a first lag pump is activated. From 2:00 A.M to 6:00 A.M. the lag pump is loaded at the same speed and flow as the lead pump. The demand on the system increases again at 9:00 A.M. The enhanced VSP solution technique determines then that the second lag pump should also be activated at the same speed and flow as the lead pump until 9:00 P.M. Such scenario illustrates that the enhanced VSP solution technique is able to model multiple variable speed pumps as a VSPB element for achieving a fixed-head target, expanding on the capabilities of prior techniques.

In a third embodiment, the enhanced VSP solution technique extends the base technique described above to enable solution for VSPs modeled with initial statuses and operating rule-based controls, in addition to target hydraulic characteristics of either fixed-head or fixed pump flow. A VSP may be set by a user to have an initial status (i.e. "on" or "off"). Further a VSP may operate under rule-based controls, for example controls specified by IF-THEN and/or IF-THEN-ELSE semantics. Different combinations of initial status, rule-based controls, along with system hydraulics, might result in different calculated operating status.

In the preferred embodiment, the enhanced VSP solution technique implements conditional logic to account for these scenarios and generate the proper operating status of "on" or "off" for each VSP. Specifically, initial status and control status limit the possible calculated status.

For instance, consider a lag VSP is turned "on" of "off" according to the capacity of the lead VSP, however, it can also be turned "on" or "off" by a control rule preset by a state value such as a clock time, a tank level, a node pressure, or a pipe flow. When the control rule triggers a lag VSP "on", it means this VSP is on standby for its lead VSP to be called upon for duty when needed. That is, the enhanced VSP solution technique may determine the lag VSP's actual operating status in response to needs of the lead VSP. The lag VSP will be turned to an operating status of "on" if the lead VSP requires it; otherwise, it will remain in an operating status of "off". However, when a control rule turns a lag VSP "off", the lag VSP should not respond to the lead VSP's call to duty. That is, if a lag VSP is preset to an "off" state (by an initial status or control rule) the enhanced VSP solution technique should never determine an operating status of the VSP to be "on" as the VSP is not participating in the operation for contributing the target head or flow.

In a forth embodiment, the enhanced VSP solution technique may solve for a VSP that is controlled by storage node such as a tank. When a tank is selected as a VSP control node, its initial level can be used as the target hydraulic head. In order to meet the target head, a VSP may be ramped up or down in response to system demand variations. There are two common cases in which a tank is used as a VSP control node: (1) where a control tank is located at the discharge side of a pump station and (2) where a control tank is located at the suction side of a pump station. The first case is sometimes found in drinking water distribution systems and the latter case is commonly found in sewer water collection systems, where a wet well is located at the suction side of a VSP.

In the case of a discharge side tank controlling a VSP, the tank's initial head should be sustained by increasing speed to fill the tank as soon as the tank begins to drain, and by reducing speed to maintain the tank level as soon as the water level increases when the system demand decreases. A solution technique is expected to calculate the correct pump speed factor to retain the target tank head.

The enhanced VSP solution technique employed by the hydraulic solver 260 of the hydraulic modeling and simulation application 150 addresses this issue by incorporating three controls when modeling a scenario involving a discharge side tank. First, when the actual tank level is lower than the target level a VSP is ramped up to the maximum allowed speed in case the target head cannot be met for a given time step of a simulation. Second, when tank level is greater than the target level, a VSP is turned off to allow the tank to drain. Third, when tank level is restored at the target level a VSP is kept in the mode of variable speed operation to maintain the target level. When these controls are implemented, a VSP controlled by a discharge side tank may be analyzed using substantially the same solution technique as depicted in the sequence of steps of FIG. 4.

Figure 10:
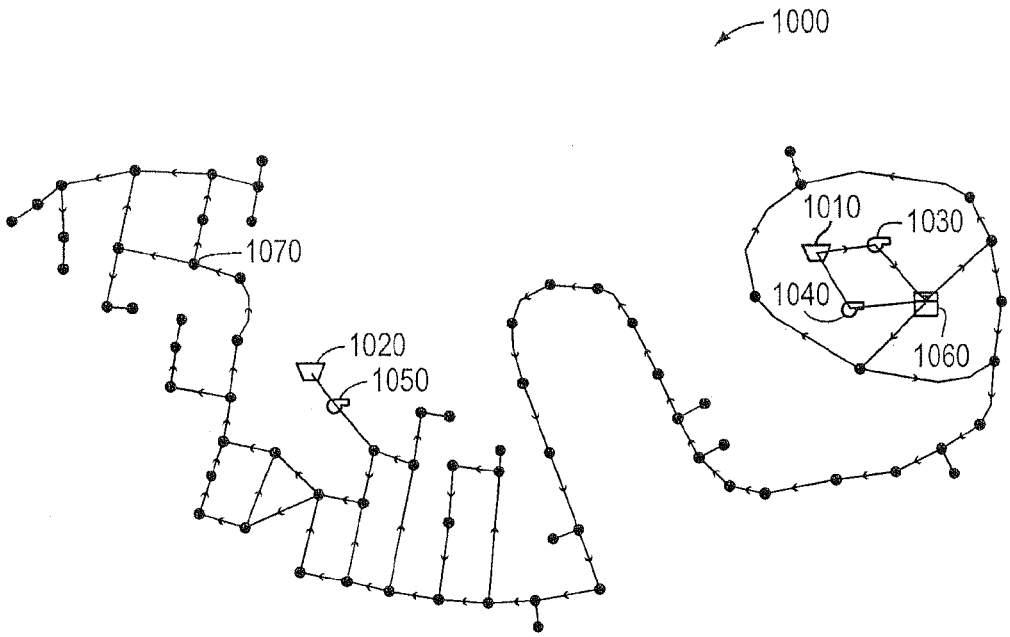
FIG. 10 is a schematic diagram of an example water distribution system that may be used to demonstrate an application of the enhanced VSP solution technique to the case of a discharge side tank controlling a VSP.

FIG. 10 is a schematic diagram of an example water distribution system 1000 that, which may be used to demonstrate an application of the enhanced VSP solution technique to the case of a discharge side tank controlling a VSP. The water distribution system 1000 is supplied by two clear wells 1010 and 1020, via three pumps: a first pump 1030, a second pump 1040, and a third pump 1050. The first pump 1030 is the primary pump. All three pumps have variable frequency drives that operate at different speeds to meet system demand and nodal pressure requirements. A downstream hydropneumatic tank 1060 controls the first pump 1030 with a target pressure head of 56 meters. The second pump 1040 is a standby pump used for emergencies, such as fire fighting. The third pump 1050 is also a variable speed pump, which moves water from the well 1020 at peak demand hours to keep the pressure head above a target level.

Two operating scenarios may be simulated. In a first scenario, the first pump 1030 is on duty and controlled by the hydropneumatic tank 1060 to provide a fixed pressure head of 56 meters over a 24-hour period, while the second pump 1040 and the third pump 1050 are turned off. In the second scenario, the first pump 1030 is on duty as in the first scenario, and the third pump 1050 is directed to provide a target pressure head of 20 meters at a particular junction 1070. In addition, a control is specified for the third pump 1050 so that it is turned on if the nodal pressure head of the junction 1070 drops below 20 meters.

Figure 11:
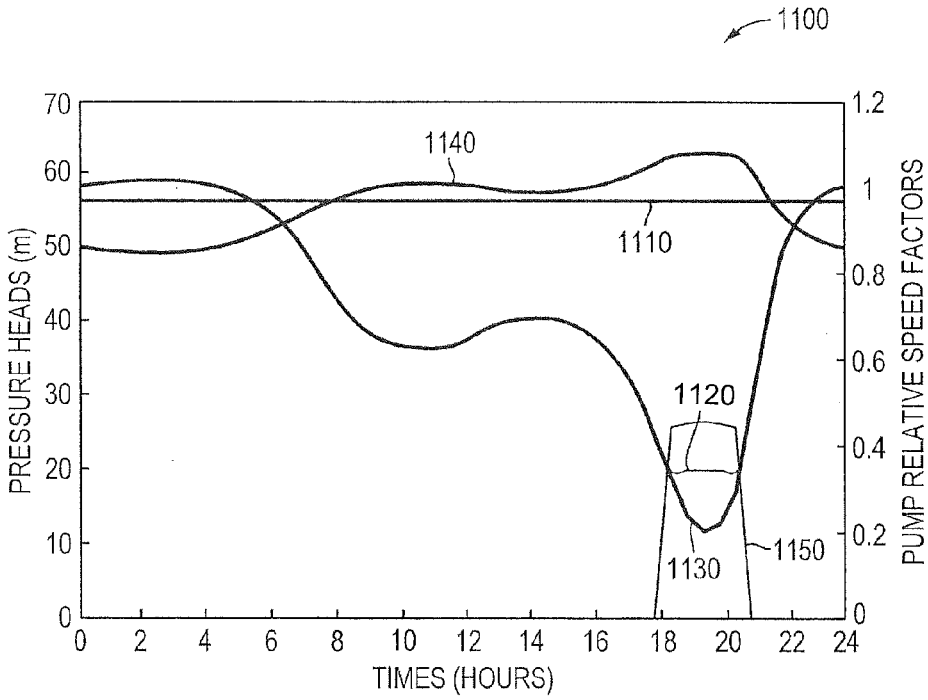
FIG. 11 depicts a graph of simulated results for two scenarios discussed in reference to FIG. 10.

FIG. 11 depicts a graph 1100 of simulated results for the two scenarios discussed in reference to FIG. 10 calculated using the above described enhanced VSP solution technique. The simulations are conducted with time step of 15 minutes and the maximum speed factor of 1.5. A line 1110 representing pressure head of tank 1060 as constant with only the first pump 1030 turned on. Line 1140 depicts calculated speed factors of the first pump 1030. In the first scenario, the pressure heads at some nodes, for example junction 1070, may drop below 15 meters at peak demand hours (e.g., 8:00 P.M) as shown by line 1130, representing pressure head at junction 1070. The simulation results of the second scenario demonstrate that the nodal pressure is maintained as required for the 24-hour service period. Specifically, the third pump 1050 is turned on to maintain the pressure head at junction 1070 above the target pressure head of 20 meters, as shown by line 1120, representing pressure head at junction 1070 with both VSPs. Line 1150 depicts the calculated speed factor of the third pump 1050. These scenarios illustrate that the enhanced VSP solution technique is able to model VSPs in which a discharge side tank controls a VSP.

Now consider the case of a suction side tank controls a VSP. Traditionally, to prevent rising water levels in wet wells, pump operations needs to be controlled within a reasonable range of water levels. With regard to constant speed pumps, control rules can be imposed to turn on a pump if wet well water level exceeds a certain threshold and shut off the pump when the water level is below a lower set point. Alternatively, the issue may be addressed with variable speed pumps by manipulating their status and speed.

In a situation where a suction side tank is selected as the VSP control node, such as in a wastewater system, the VSP is expected to keep the tank level substantially constant. The enhanced VSP solution technique employed by the hydraulic solver 260 of the hydraulic modeling and simulation application 150 addresses this issue by incorporating two controls when modeling a scenario involving a suction side tank. First, when the tank level is greater than the target level a VSP is turned off to allow the tank to drain. Second, when the tank level is restored at the target level a VSP is kept in the mode of variable speed operation to maintain the target level. When these controls are implemented, a suction-side tank level can be modeled as a control target for VSP using substantially the same solution technique as depicted in the sequence of steps of FIG. 4.

Figure 12:
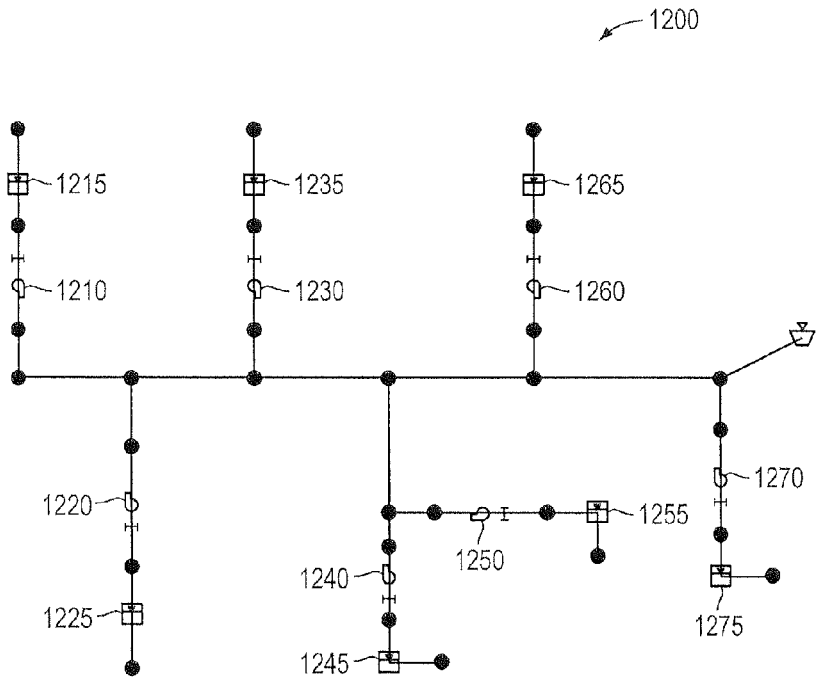
FIG. 12 is a schematic diagram of a portion of an example water collection system in which pumps move wastewater out of wet wells, which may be used to demonstrate an application of the enhanced VSP solution technique.

An example may be employed to demonstrate the application of the enhanced VSP solution technique to the case of a suction side tank controlling a VSP. FIG. 12 is a schematic diagram of a portion of an example water collection system 1200 in which pumps move wastewater out of wet wells. Seven VSPs 1210, 1220, 1230, 1240, 1250, 1260, and 1270 are connected to respective wet wells 1215, 1225, 1235, 1245, 1255, 1265, 1275 to preserve a constant water level in the wet wells. When the water rises, pump operation needs to be controlled to maintain a reasonable range of water levels. In order to prevent overflow from wet wells and avoid the pump operating with too little flow, two options can be adopted. In a first, one may use constant speed pumps with rule-based controls, for instance for the fifth wet well 1250, control rules may be specified as:

IF {Wet Well 5 Hydraulic Grade<7.0 ft} THEN {Pump 5 Status=OFF}

IF {Wet Well 5 Hydraulic Grade>13.0 ft} THEN {Pump 5 Status=ON}

The second option may be to use variable speed pumps controlled by suction side wet well as the target, the pump speed being directly calculated for maintaining the fixed water level of a wet well.

Figure 13:
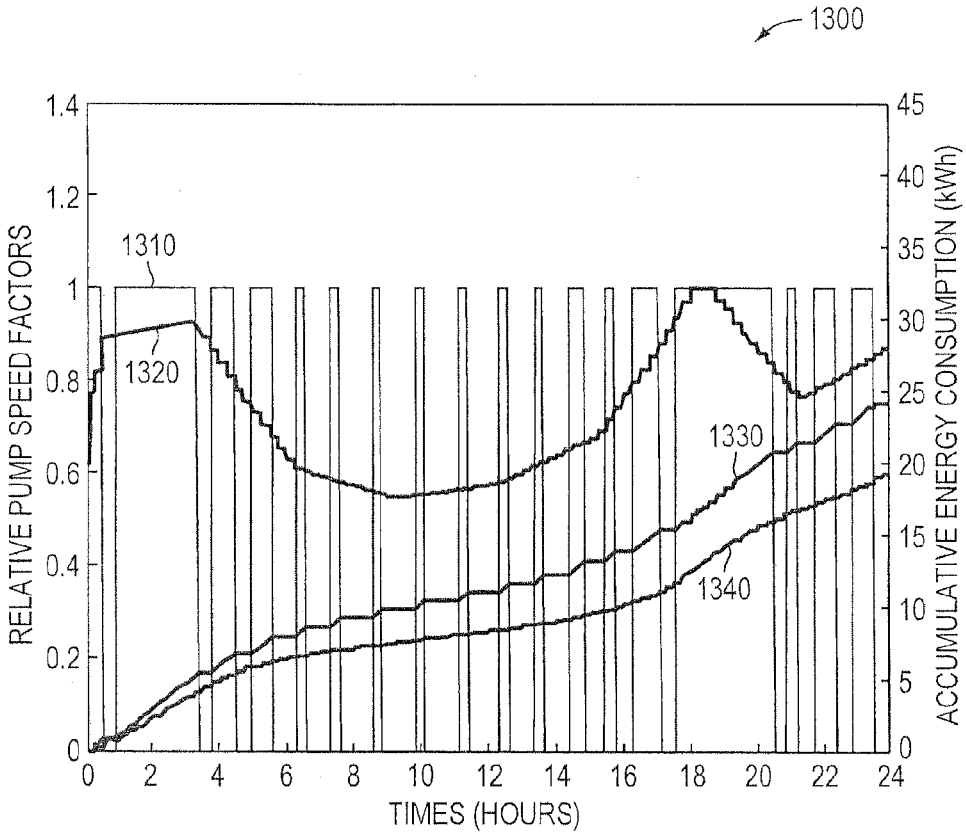
FIG. 13 depicts a graph of simulated results for two options discussed in reference to FIG. 12 for a particular pump controlled by a particular wet well.

While the first scenario may be simulated using a variant of the base VSP solution technique, without direct calculation of pump speed but using constant speed pumps controlled by logic controls, the second scenario requires the above described enhanced VSP solution technique. FIG. 13 depicts a graph 1300 of simulated results for the two options discussed in reference to FIG. 12 for fifth pump 1250 controlled by fifth wet well 1255. For the first option, a first line 1310 depict a constant speed pump speed factor for fifth pump 1250, while a second line 1330 depicts projected cumulative energy use for the pump in kilowatts per hour. Similarly, for the second option, a line 1320 depicts a VSP speed factor for fifth pump 1250, while a second line 1340 depicts projected cumulative energy use for the pump in kilowatts per hour. The results illustrate that the CSP must frequently changes pumping status in order to preserve the water level in the prescribed range. In contrast, the VSP simply may adjust its speed to attain the fixed wet well water level over 24 hours, consuming less energy and producing less wear on the pup due to frequent cycling.

Such scenarios not only illustrate that the enhanced VSP solution technique is able to model VSPs controlled by suction side tank, but further illustrate the desirability of employing VSPs now that they may be modeled and simulated in a more flexible and robust manner.

In summary, the extended VSP solution technique described herein enables calculation of pump speed under a wide range of VSP configurations for achieving desired hydraulic characteristics for fixed hydraulic heads or fixed pump flows. The technique is effective at modeling challenging control scenarios including fixed-flow VSPs, VSPs operating in parallel to deliver certain target hydraulic characteristics, VSPs having initial statuses and operating under rules-based controls in addition to target hydraulic characteristics of either fixed-head or fixed pump flow, and/or VSPs for maintaining fixed-head of a storage tank located at either discharge side or suction side of a pump. Further, a new modeling element, namely a VSPB element, is also described that leverages the solution technique for modeling multiple identical VSPs and associated controls.

While the above description discusses various embodiments, it should be apparent that a number of modifications and/or additions may be made without departing from the disclosure's intended spirit and scope.

For example, while the above description focuses on modeling and simulating water distribution and collection systems, it should be apparent that underlying techniques are applicable to a wider variety of other types of systems, including modeling and simulation other types of fluid conveyance systems that may convey fluids other than water.

Further, the above described techniques may be implemented in software, in hardware, or in a combination thereof. A software implementation may include computer-executable instructions embodied in a computer-readable storage medium, for example a CD, a DVD, a hard-disk, a solid-state storage device, a volatile storage device, or other tangible medium. A hardware implementation may include processors, memories, programmable logic circuits, application specific integrated circuits, and/or other types of hardware components. Further, a combined software/hardware implementation may include both computer-executable instructions embodied in a computer-readable medium, as well as one or more hardware components.

Accordingly, it should be understood that the above descriptions are meant to be taken only by way of example.

What is claimed is:

1. A method comprising:

defining a hydraulic model of a water distribution or collection system in a hydraulic modeling and simulation application executing on a computer system, the hydraulic model including link elements and node elements that define a configuration, at least one node element representing a variable speed pump (VSP) having a tank located on the VSP's discharge side that serves as the VSP's control node in the configuration or having a tank located on the VSP's suction side that serves as the VSP's control node in the configuration;

initializing values of one or more hydraulic heads and link flows in the hydraulic model;

computing system matrixes descriptive of the hydraulic model;

solving the matrixes to determine new values of the one or more hydraulic heads;

updating link flows from current values to new values based upon the new values of the one or more hydraulic heads;

repeating the steps of computing, solving and updating until a change between current values to new values of link flows is less than a predetermined accuracy tolerance;

causing the VSP to be set to an operating status of off, or to a variable speed mode of operation, depending on tank level at the VSP's control node in relation to a target level at the VSP's control node;

when the VSP is set to a variable speed mode of operation, using the new values of link flows and hydraulic heads to calculate at least one VSP speed at a time step;

further repeating the steps of initializing, computing, solving, updating, repeating, and using for a plurality of time steps, with the VSP being set to each of the operating status of off and the variable speed mode of operation for at least some time steps, until a current time step is determined to be greater than a simulation duration; and including the at least one VSP speed at each time step in results of a simulation of the hydraulic model, the results displayed to a user by the computer system.

2. The method of claim 1 wherein at least one additional node element represents a fixed-flow VSP that delivers a desired amount of flow.

3. The method of claim 2 further comprising:

maintaining a calculated pump flow for the fixed-flow VSP equal to a target flow of the fixed-flow VSP over one or more iterations of the steps of computing, solving and updating.

4. The method of claim 3 wherein the maintaining is implemented such that:

$$q_i^{k+1}=q_i^{k}=q_i^{target}$$

where $q_i^{k}$ is a calculated flow for a pump i at a k-th iteration; $q_i^{k+1}$ is a calculated flow for pump i at a (k+1)-th iteration and $q_i^{target}$ is a target flow for pump i.

5. The method of claim 1 wherein at least one additional node element represents a variable speed pump battery (VSPB) element that represents multiple VSPs operating in parallel with each other.

6. The method of claim 5 wherein the VSPB element further represents VSPs that are identical and that are controlled by a same target node, a same target head, or are expected to move a same target flow.

7. The method of claim 5 wherein the multiple VSPs operating in parallel represented by the VSPB element are treated as a single equivalent pump having same characteristics as the multiple VSPs operating in parallel, and wherein the equivalent pump is used in calculating the least one VSP speed.

8. The method of claim 5 wherein the step of defining further comprises:

providing a VSPB tool in a user interface of the hydraulic modeling and simulation application, the VSPB tool, when manipulated, to create a VSPB element in the hydraulic model.

9. The method of claim 1 wherein the least one VSP speed indicates a calculated operating status of on or off.

10. The method of claim 9 wherein the calculated operating status is constrained by a rule-based control.

11. The method of claim 10 wherein the rule-based control is specified by IF-THEN or IF-THEN-ELSE semantics.

12. The method of claim 1 wherein the at least one node element represents a VSP with a tank located on the VSP's suction side and the VSP is controlled to maintain the target level.

13. An apparatus comprising:

a processor;

a memory configured to store computer-executable instructions for execution on the processor, the computer-executable instructions implementing, a hydraulic model of a water distribution or collection system, the hydraulic model including link elements and node elements that define a configuration, at least one node element representing a variable speed pump (VSP), having a tank located on the VSP's discharge side that serves as the VSP's control node in the configuration or having a tank located on the VSP's suction side that serves as the VSP's control node in the configuration, and a hydraulic solver configured to initialize values of one or more hydraulic heads and link flows in the hydraulic model, compute system matrixes descriptive of the hydraulic model, solve the matrixes to determine new values of the one or more hydraulic heads, update link flows from current values to new values based upon the new values of the one or more hydraulic heads, repeat the operations of compute, solve and update until a change between current values to new values of link flows is less than a predetermined accuracy tolerance, cause the VSP to be set to an operating status of off, or to a variable speed mode of operation, depending on tank level at the VSP's control node in relation to a target level at the VSP's control node, when the VSP is set to a variable speed mode of operation use the new values of link flows and hydraulic heads to calculate at least one VSP speed at a time step, further repeat the operations of initialize, compute, solve, update, repeat, and use for time steps, with the VSP being set to each of the operating status of off and the variable speed mode of operation for at least some time steps, until a current time step is determined to be greater than a simulation duration; and a display configured to display results that include the at least one VSP speed at each time step.

14. A non-transitory computer-readable storage medium including instructions executable by a processor, the instructions when executed by the processor operable to:

define a hydraulic model of a water distribution or collection system, the hydraulic model including link elements and node elements that define a configuration, at least one of the node elements representing a fixed-flow variable speed pump (VSP) having a tank located on the VSP's discharge side that serves as the VSP's control node in the configuration or having a tank located on the VSP's suction side that serves as the VSP's control node in the configuration;

initialize values of one or more hydraulic heads and link flows in the hydraulic model;

compute system matrixes descriptive of the hydraulic model;

solve the matrixes to determine new values of the one or more hydraulic heads;

update link flows from current values to new values based upon the new values of the one or more hydraulic heads;

repeat the operations of compute, solve and update until a change between current values to new values of link flows is less than a predetermined accuracy tolerance;

cause the VSP to be set to an operating status of off, or to a variable speed mode of operation, depending on tank level at the VSP's control node in relation to a target level at the VSP's control node;

when the VSP is set to a variable speed mode of operation, use the new values of link flows and hydraulic heads to calculate at least one VSP speed at a time step;

further repeat the operations of initialize, compute, solve, update, repeat, and use for time steps, with the VSP being set to each of the operating status of off and the variable speed mode of operation for at least some time steps, until a current time step is determined to be greater than a simulation duration; and include the at least one VSP speed in results of a simulation of the hydraulic model, the results displayed to a user.

15. The non-transitory computer-readable storage medium of claim 14, wherein the instructions further include instructions that when executed by the processor are operable to:

set a calculated pump flow for the VSP equal to a target flow of the VSP to maintain VSP flow constant.

16. The non-transitory computer-readable storage medium of claim 14, wherein at least one additional node element represents a variable speed pump battery (VSPB) and the instructions further include instructions that when executed by the processor are operable to:

treat the VSPB as a single equivalent pump having same characteristics as multiple VSPs operating in parallel and wherein the equivalent pump is used in calculation of the at least one VSP speed.

17. The non-transitory computer-readable storage medium of claim 14, wherein the instructions further include instructions that when executed by the processor are operable to:

constrain an operating status of the VSP by a rule-based control specified by IF-THEN or IF-THEN-ELSE semantics.

18. The non-transitory computer-readable storage medium of claim 14, wherein the instructions further include instructions that when executed by the processor are operable to:

implement controls to, a) if the VSP is turned on and the tank level is greater than the target level, change the VSP to a maximum allowed speed to bring the tank level down to a target level, and b) if the tank level is lower than the target level, slow the VSP in a variable speed mode of operation to return to the target level.

* * * * *

UNITED STATES PATENT AND TRADEMARK OFFICE

CERTIFICATE OF CORRECTION

PATENT NO. : 8,265,911 B1
APPLICATION NO. : 12/201529
DATED : September 11, 2012
INVENTOR(S) : Zheng Yi Wu et al.

It is certified that error appears in the above-identified patent and that said Letters Patent is hereby corrected as shown below:

Col. 1, line 57 should read: "different ~~characterises tics~~ characteristics curves. Therefore, the VSPs offer"

Signed and Sealed this
Twenty-seventh Day of November, 2012

David J. Kappos

David J. Kappos
*Director of the United States Patent and Trademark Office*